US011069262B2

(12) United States Patent
Kunreuther

(10) Patent No.: US 11,069,262 B2
(45) Date of Patent: Jul. 20, 2021

(54) DISPLAY CARD AND METHOD OF PACKAGING

(71) Applicant: Texpak, Inc., Franklin Square, NY (US)

(72) Inventor: Steven Kunreuther, New York, NY (US)

(73) Assignee: TEXPAK, INC., Franklin Square, NY (US)

( * ) Notice: Subject to any disclaimer, the term of this patent is extended or adjusted under 35 U.S.C. 154(b) by 0 days.

(21) Appl. No.: 16/695,578

(22) Filed: Nov. 26, 2019

(65) Prior Publication Data

US 2020/0242976 A1 Jul. 30, 2020

Related U.S. Application Data

(60) Provisional application No. 62/797,725, filed on Jan. 28, 2019.

(51) Int. Cl.
*G09F 1/04* (2006.01)

(52) U.S. Cl.
CPC ..... *G09F 1/04* (2013.01)

(58) Field of Classification Search
CPC ..... B65D 73/00; B65D 73/02; B65D 85/20; B65D 73/0007; B65D 73/0021; G09F 1/04; G09F 5/00; G09F 5/04; G09F 5/042
USPC ..... 206/443, 446, 477–482, 495
See application file for complete search history.

(56) References Cited

U.S. PATENT DOCUMENTS 1,201,979 A * 10/1916 Noyes ..... B65D 73/0014 206/478
2,387,639 A * 10/1945 Bouchelle ..... G09F 5/042 206/481
3,811,565 A * 5/1974 Tancredi ..... B65D 25/102 206/478
3,908,827 A * 9/1975 Bemmels ..... B65D 73/005 206/478
3,927,765 A * 12/1975 Beal ..... B65D 73/0014 206/481
4,023,759 A * 5/1977 Perkins ..... B65D 73/0014 206/488

FOREIGN PATENT DOCUMENTS

DE 4413139 A1 * 11/1994 ..... B65D 73/0021
GB 322987 A * 12/1929 ..... G09F 5/042

* cited by examiner

*Primary Examiner* — Bryon P Gehman
(74) *Attorney, Agent, or Firm* — Epstein Drangel LLP; Robert L. Epstein

(57) ABSTRACT

A display card with a surface is formed of a paper product. The card has spaced, oppositely oriented, integral die cut flap members each of which is positioned to be generally perpendicular to the card surface. One or more products are placed on the card, between the flap members. A fastener is then applied to the card, over the products, with the ends of the fastener anchored to the card, at either side of the products. In this manner, the products are securely mounted on the display card, eliminating the need for a blister package.

15 Claims, 5 Drawing Sheets

DISPLAY CARD AND METHOD OF PACKAGING

CROSS-REFERENCE TO RELATED APPLICATIONS

Priority is claimed on Provisional Patent Application Ser. No. 62/797,725, filed Jan. 28, 2019, which is incorporated herein in its entirety by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to display cards and to a method of packaging and displaying products, including products with cylindrical portions, on such display cards.

2. Description of Prior Art Including Information Disclosed Under 37 CFR 1.97 and 1.98

One of Avery Dennison's more successful products is the Elastic Staple or IndES which is often used to replace blister packaging when attaching products to cards. This is an environmentally sustainable packaging method as it eliminates a significant amount of plastic that is used in blister packaging. In addition, in many cases it is less costly for the manufacturer to use this method when compared to blister pack.

As can be seen from the Avery Dennison U.S. Pat. No. 6,536,648, the products are attached to the cards by staples applied by a machine which has two spaced parallel hollow needles, one of which is inserted into the card on either side of the product, and a flexible plastic filament with "T bars" on either end. The "T bars" travel through the needles and emerge on the other side of the card. In this operation, the filament mounts the product to card.

Many different shaped products are presently packaged on display cards using this method. The method works well with cylindrical products with wider and narrower portions (non-uniform diameters), such as paint brushes, screw drivers, ice cream scoops and the like. For those products, it is not possible for a consumer to simply remove the product from the card without breaking the staples, when the staples are applied to one of the narrower sections of the article.

However, at present it is virtually impossible to secure products with certain shapes to a display card with the Avery Dennison staples, including cylindrically shaped products with substantially uniform diameters such as pens and markers, products with a continuously decreasing width or products having a flat rectangular shape with the same width throughout. No matter how tight the staple is on the product, it can never be tight enough to prevent a consumer from sliding the product out from underneath the staples.

There is therefore a need for a display card, and for a method for displaying and packaging products including cylindrically shaped products with substantially uniform diameters, products with a continuously decreasing width or products with a flat rectangular shape with uniform width throughout on a display card, which has the advantages of the Avery Dennison staple, but which can be used to mount such products to a display card in a manner that prevents the removal of the product without breaking the fastener.

BRIEF SUMMARY OF THE INVENTION

In its simplest form, the present invention is a display card with a surface, formed of a paper product. The card has spaced, oppositely oriented flap members situated in a position generally perpendicular to the card surface. One or more products are placed on the card, between the flap members. A fastener is then applied to the card, over the products, with the ends of the fastener anchored to the card, at either side of the products. The products cannot be removed from the card without breaking the fastener because the flap members prevent the products from being moved in either direction relative to the card body.

More specifically, in accordance with one aspect of the present invention, a display card is provided having a body with a substantially planar surface. A member extends from surface to a position substantially perpendicular to the body surface. An elongated fastener extends from the body surface and defines an opening with the body surface. The opening is aligned with and spaced from the member.

The member is preferably integral with the card body. The member may take the form of a flap die cut from card body.

The card body has an edge which extends along the width of the card body. The member and the elongated fastener each extend in a direction substantially parallel to the edge of the card body.

The fastener includes a flexible plastic filament. The filament has first and second ends. The filament ends penetrate the card surface in order to anchor the filament to the card body. Each end of the filament has an enlarged part which lodges behind the card body.

A second member, integral with the card body, may be provided extending from the card surface to a position substantially perpendicular to the card surface. The members are spaced apart such an article can be received therebetween. The second member preferably takes the form of a flap die cut from the card body.

In accordance with another aspect of the present invention, a card is provided for displaying a product having an end. The card includes a body having a substantially planar surface. A member extends from the card surface to a position substantially perpendicular to the card surface and proximate the end of the product. An elongated fastener extends from the card surface to maintain the product adjacent the card surface.

The article has a second end. The card includes a second member. The second member extends from the card surface to a position substantially perpendicular to the card surface. The second member is situated at a location spaced from first member, and proximate the second end of the article.

In accordance with another aspect of the present invention, a card is provided for displaying a product having a portion with a generally cylindrical shape having first and second ends. The card includes a body having a substantially planar surface. First and second spaced members, each extending from the card surface to a position substantially perpendicular to the card surface, are situated with the product extending therebetween. An elongated fastener extends from the card surface to maintain the product adjacent the card surface.

In accordance with another aspect of the present invention, a method is provided of securing a product with an end to a display card of the type having a body with a substantially planar surface. The method includes the following steps: forming a member in the body; rotating the member to a position substantially perpendicular to the body surface; placing the product adjacent the body surface with the end thereof proximate the member; and attaching an elongated fastener to the card body to maintain the product adjacent the body surface.

The product has a second end. The method further includes the steps of: forming a second member in the body at a location spaced from the first member; rotating the second member to a position substantially perpendicular to the body surface; and placing the product adjacent the body surface with the ends thereof between the first member and the second member.

BRIEF DESCRIPTION OF THE SEVERAL VIEWS OF DRAWINGS

To these and to such other objects that may hereinafter appears, the present invention relates to a display card and a method of displaying and packaging an article on such a display card, as described in detail in the following specification and recited in the annexed claims, taken together with the accompanying drawings, in which like numerals refer to like parts and in which:

Figure 4:
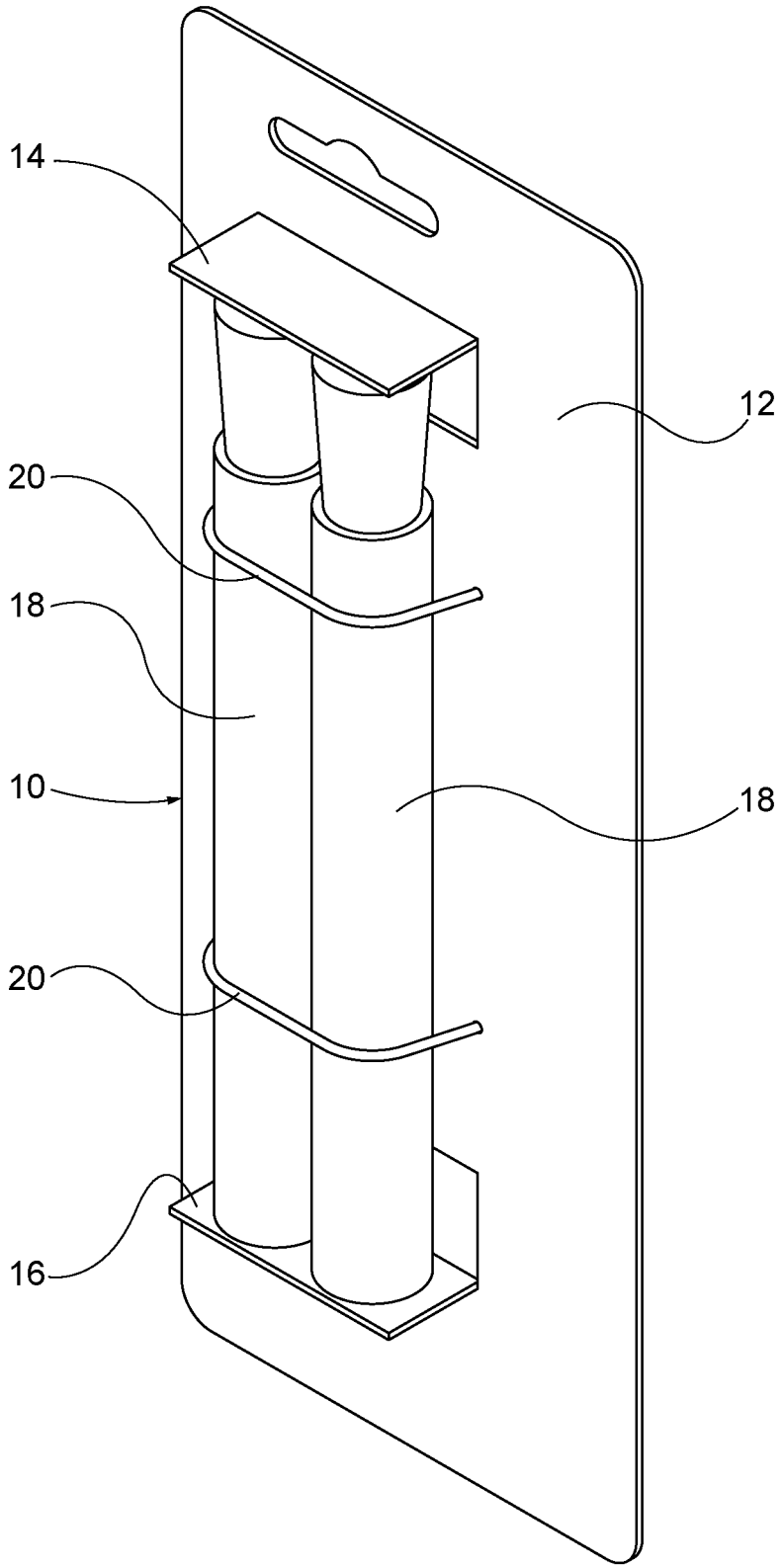
FIG. 4 is a perspective view of the markers of FIG. 3 mounted on the display card of FIG. 2 by two spaced filament fasteners, each fastener having "T-bar" ends.
Figure 5:
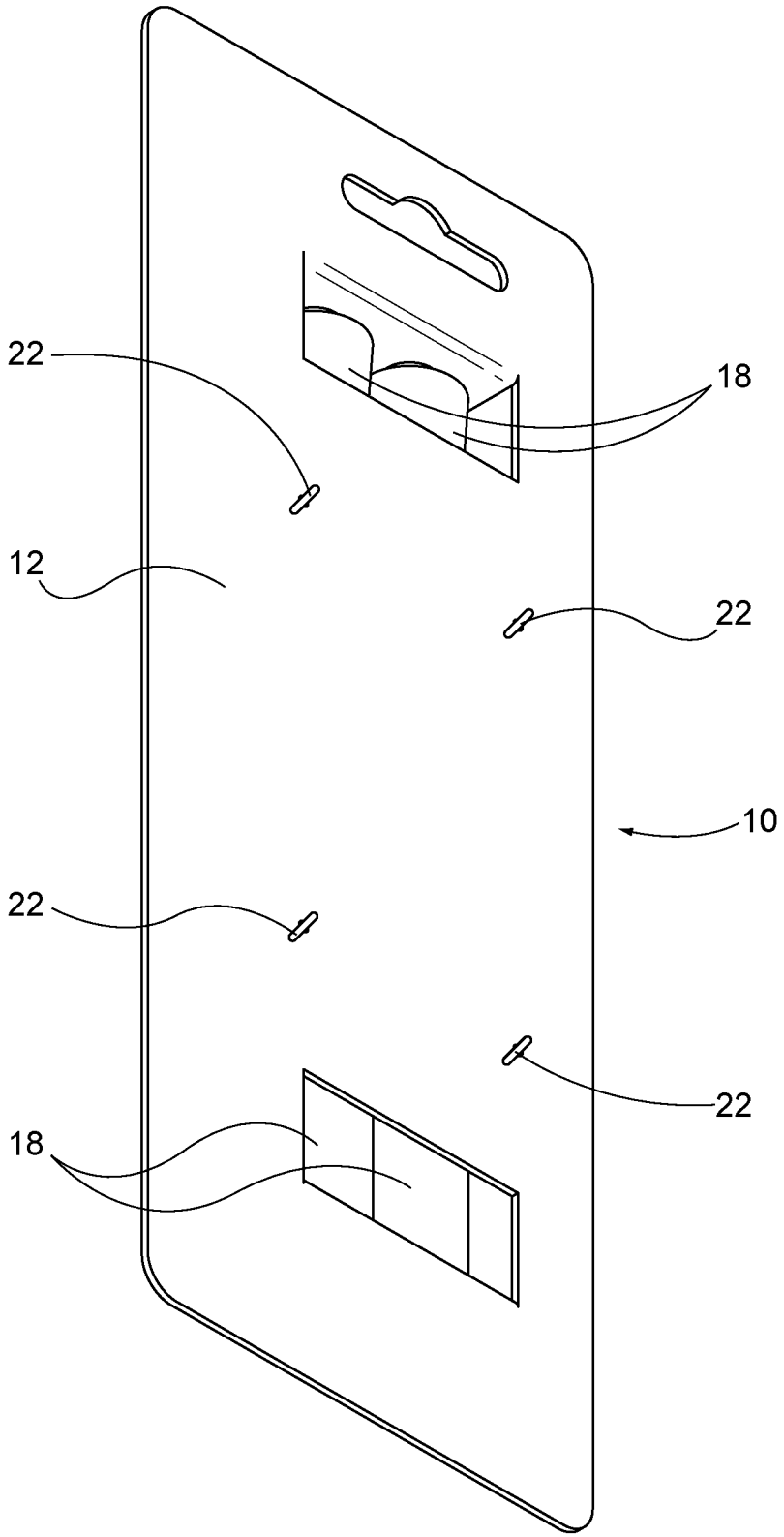
Figure 6:
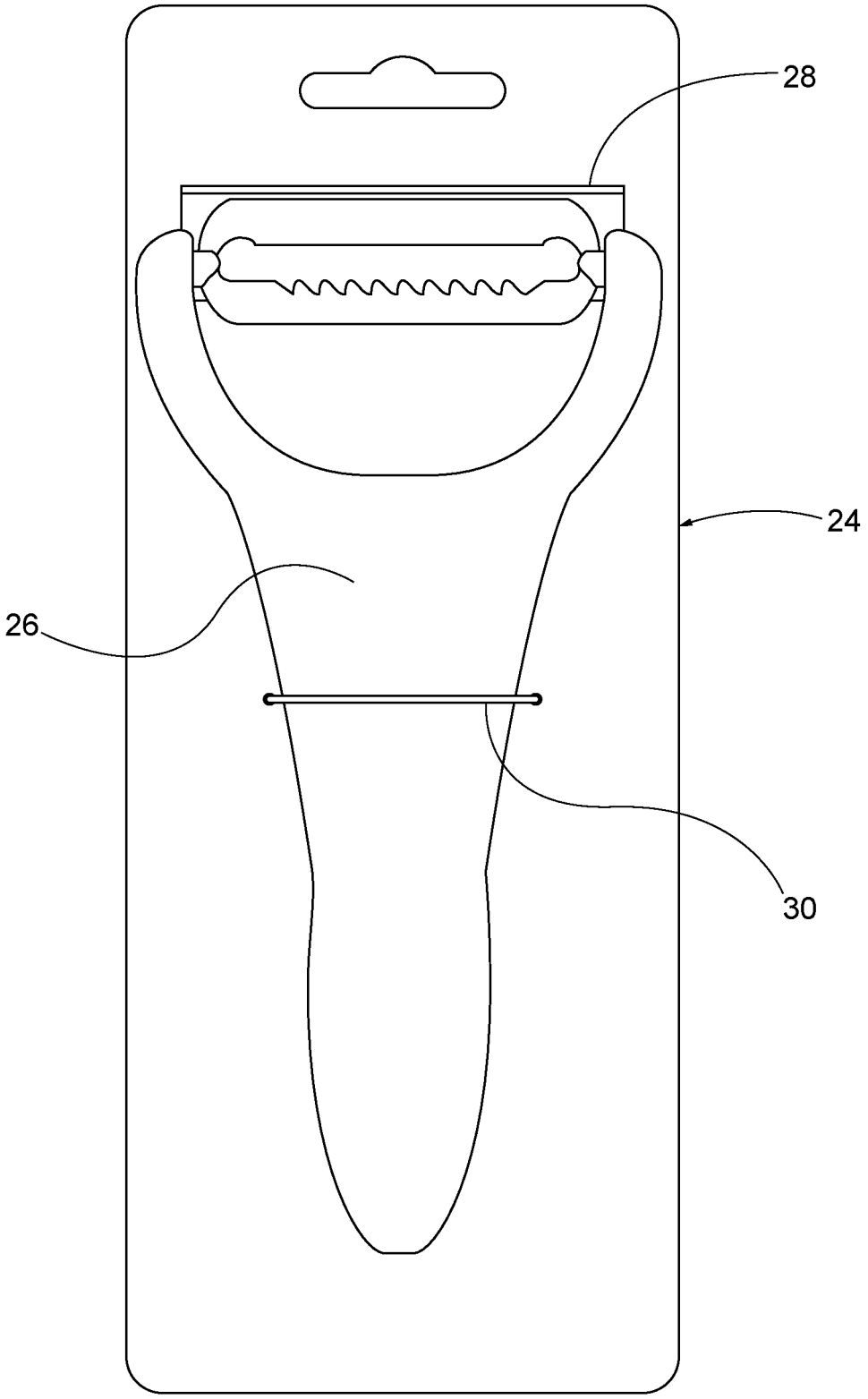

FIG. 5 is a perspective view of back of the display card of FIG. 4 showing the "T-bar" ends of the fasteners lodged against the back surface of the card; and FIG. 6 is a front elevation view of a second preferred embodiment of the present invention wherein a single flap member and a single filament fastener with "T-bar" ends are used to mount a product with a continuously decreasing width on the display card.

DETAILED DESCRIPTION OF THE INVENTION

Figure 1:
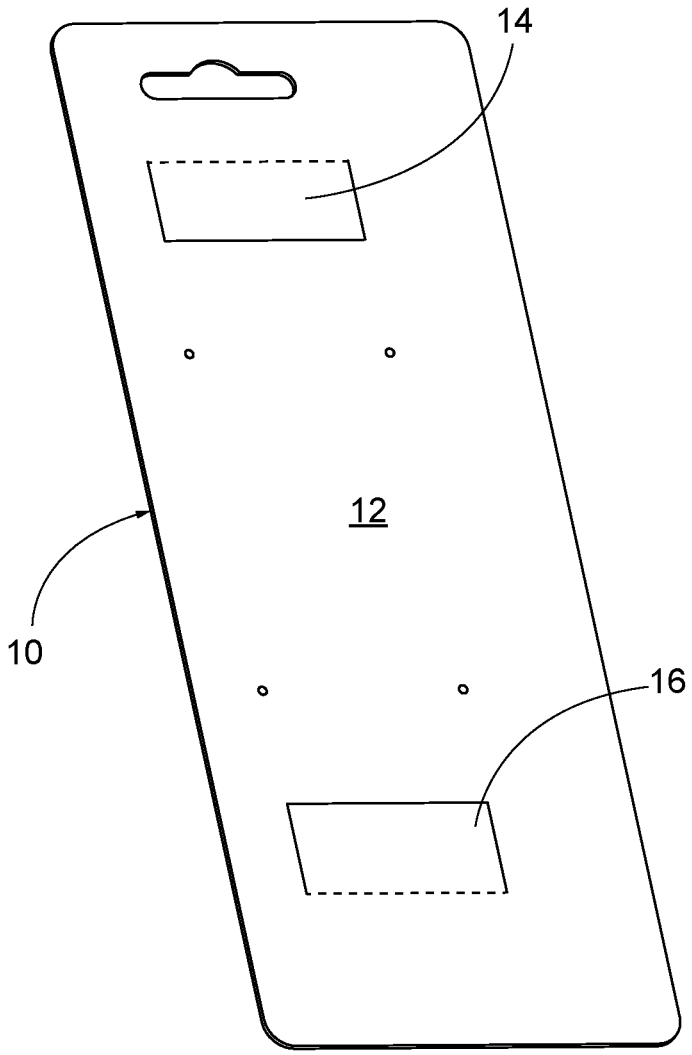
FIG. 1 is a perspective view of a first preferred embodiment of the display card with the flap members die cut.

As seen in FIG. 1, the first preferred embodiment of the present invention includes a display card 10 formed of a paper product such as thin cardboard. It is preferable to select one of the many card stocks presently available that are difficult to bend more than 90 degrees. Such a paper stock makes it difficult to bend the card to a position where the product can be removed from the card.

The display card as illustrated has a generally rectangular shaped body with a substantially planar front surface 12. However, the display card can have any shape, as long as the card is large enough to accommodate the product which will be carried by the display card. Surface 12 is substantially continuous without a recess or opening into which the product to be displayed could be received.

First and second spaced flap members 14, 16 are die cut in the card body in a manner which leaves bottom edge of each flap member attached to the card body, as indicated by the broken lines in the figure. In that way, each flap member remains integral with and connected to the card body and can be rotated or folded about an axis along the bottom of the flap member. The fold lines extend in a direction generally parallel each other and parallel to the top and bottom edges of the display card.

Figure 2:
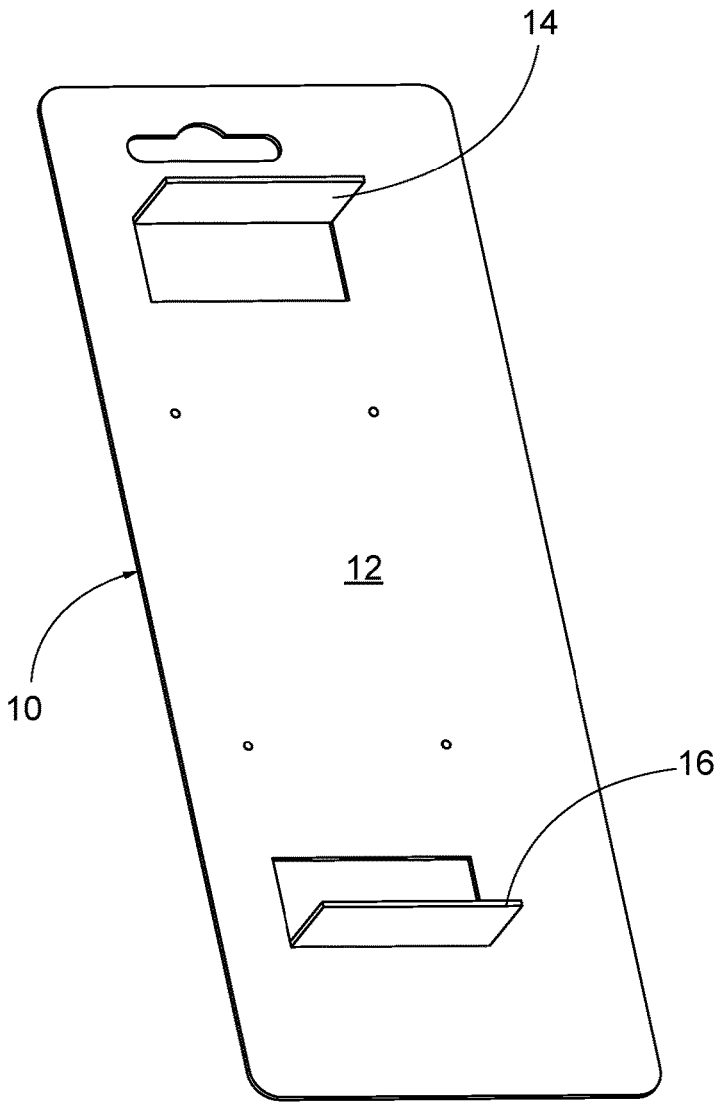
FIG. 2 is a perspective view of the display card of FIG. 1 with each of the flap members rotated to a position perpendicular to the front surface of the display card.

FIG. 2 shows the display card of FIG. 1 with flap members 14, 16 rotated to their respective product engagement positions, substantially perpendicular to the front surface 12 of the display card. In that position, the flap members provide additional resistance to bending the display card to remove the product.

Figure 3:
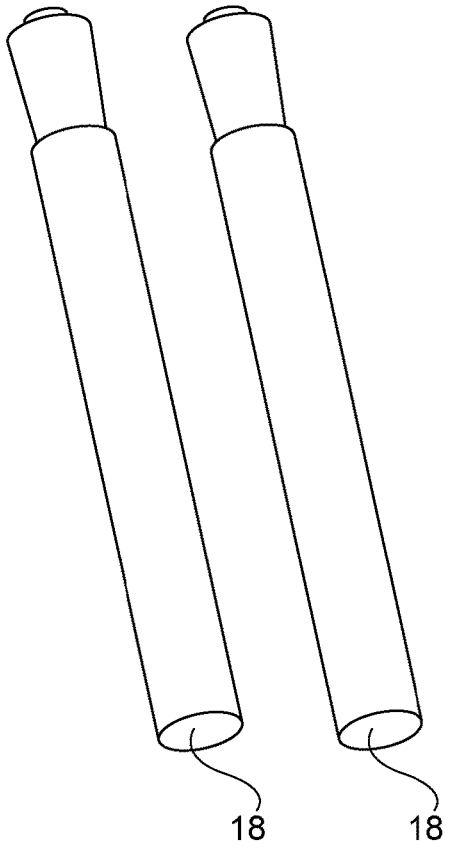
FIG. 3 is a perspective view of two markers of the type which could be mounted on the display card of FIG. 2.

FIG. 3 shows two cylindrically shaped markers 18 with substantially uniform diameters of the type which could be mounted on display card 10. Markers 18 would normally require a blister package to retain the markers. The blister package would be required to prevent the markers from sliding out from under the filament fasteners on a conventional display card.

FIG. 4 shows flap members 14, 16 rotated or folded to their product engagement positions substantially perpendicular to the front surface 12 of the display card with the markers 18 in a side-by-side relation extending between flap members 14 and 16. FIG. 4 also shows two spaced flexible filament fasteners 20, each with enlarged "T-bar" ends 22 anchored on either side of the markers 18. The filaments of the fasteners extend in a direction generally parallel to each other, and parallel to the top and bottom edges of the display card.

FIG. 5 shows the back of the display card 10 of FIG. 4, with the "T bar" ends 22 of each fastener 20 lodged against the back surface of the display card.

FIG. 6 illustrates a second preferred embodiment of the display card 24. This embodiment may be used to mount products with continuously decreasing widths to the card, for example a cheese grater 26. Because of the shape of the cheese grater, only a single flap member 28 and a single filament fastener 30 are required to securely mount the cheese grater to the card.

It will now be understood that an product can be securely mounted to the display card of the present invention having a planar surface, without the necessity of a blister package, by the following steps: forming at least one flap member in the card body; rotating the at least one flap member to a position substantially perpendicular to the body surface; placing the product adjacent the body surface with the end thereof proximate the flap member; placing an elongated filament fastener over the product and attaching the ends of the fastener to the card body.

For products which have cylindrical portions with a substantially uniform diameter, the method further includes the steps of: forming a second flap member in the card body at a location spaced from the first flap member; rotating the second flap member to a position substantially perpendicular to the body surface; placing the product adjacent the body surface with the ends thereof between the first flap member and the second flap member; and attaching the ends of a second elongated filament fastener to the card body at a location spaced from the first fastener.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims:

I claim:

1. A card for displaying a product having a first end and a second end, said card comprising a surface in a plane, a first flap member having a surface cut from the card surface so as to form a first opening in said card surface, a second flap member having a surface cut from said card surface so as to leave a second opening in said card surface, said first opening and said second opening being spaced from each other along a substantially continuous portion of said card surface, said first flap member and said second flap being situated in substantially parallel spaced planes adapted to receive the entire product therebetween when the product is positioned adjacent the substantially continuous card surface portion with the first end of the product abutting said surface of said first flap member and the second end of the product abutting said surface of said second flap member, and a fastener spaced from said first flap member and second flap member extending from said card surface to secure the product to the card.

2. The card of claim 1 wherein said members are integral with said card.

3. The card of claim 1 wherein said members each comprise a substantially continuous flap cut from said card.

4. The card of claim 1 wherein said card has an edge and said members extend in a plane substantially parallel to said card edge.

5. The card of claim 1 wherein said card has an edge and said fastener extends in a direction substantially parallel to said edge.

6. The card of claim 1 wherein said members and said fastener extend in planes substantially parallel to each other.

7. The card of claim 1 wherein said card has an edge and each of said members and said fastener extend in a plane substantially parallel to said edge.

8. The card of claim 1 wherein said card is generally rectangular.

9. The card of claim 1 wherein said card has a width and wherein each of said members and said fastener extend in a direction along said width of said card.

10. The card of claim 1, wherein said fastener comprises a filament.

11. The card of claim 10 wherein said filament comprises first and second ends, said ends being adapted to penetrate said surface to anchor said ends of said filament to said card.

12. The card of claim 10 further comprising an enlarged part attached to each of said ends.

13. The card of claim 1 wherein said fastener comprises a flexible plastic filament with an enlarged part at each end.

14. In combination, a product having a first end and a second end and a card for displaying said product, said card comprising a surface in a plane, a first flap member having a surface cut from the card surface so as to form a first opening in said card surface, a second flap member having a surface cut from said card surface so as to leave a second opening in said card surface, said first opening and said second opening being spaced from each other along a substantially continuous portion of said card surface, said first flap member and said second flap member being situated in substantially parallel spaced planes adapted to receive said product entirely therebetween when said product is positioned adjacent the substantially continuous card surface portion with the first end of said product abutting said surface of said first flap member and the second end of said product abutting said surface of said second flap member, and a fastener spaced from said first and second flap members extending from said card surface to secure said product to the card.

15. A method of securing a product to a card for displaying a product having a first end and a second end, the card comprising a surface in a plane, the method comprising the steps of:

(a) forming a first flap member having a surface cut from the card surface so as to form a first opening in said card surface;

(b) forming a second flap member having a surface cut from said card surface so as to leave a second opening in said card surface;

(c) locating said first opening and said second opening spaced from each other along a substantially continuous portion of the card surface;

(d) positioning said first flap member and second flap member in substantially parallel spaced planes to receive the entire product therebetween;

(e) positioning the product adjacent the substantially continuous card surface portion with the first end of the product abutting the surface of the first flap member and the second end of the product abutting the surface of the second flap member; and (f) attaching a fastener to the card surface at a location spaced from the first flap member and the second flap member to secure the product to the card.

* * * * *